US006612137B2

(12) United States Patent
Smulowitz

(10) Patent No.: US 6,612,137 B2
(45) Date of Patent: Sep. 2, 2003

(54) MAGNETIC/ELECTROMAGNETIC APPARATUS AND PROCESS FOR LAUNDERING GARMENTS IN AN INDUSTRIAL, COMMERCIAL OR RESIDENTIAL MEDIUM

(75) Inventor: Marc S. Smulowitz, P.O. Box 285, Harveys Lake, PA (US) 18618

(73) Assignee: Marc S. Smulowitz, Harveys Lake, PA (US)

( * ) Notice: Subject to any disclaimer, the term of this patent is extended or adjusted under 35 U.S.C. 154(b) by 78 days.

(21) Appl. No.: 09/779,027

(22) Filed: Feb. 7, 2001

(65) Prior Publication Data

US 2002/0104170 A1 Aug. 8, 2002

(51) Int. Cl.[7] ..... D06F 39/00
(52) U.S. Cl. ..... 068/13 R
(58) Field of Search ..... 68/13 R, 207, 68/235 R, 17 R

(56) References Cited

U.S. PATENT DOCUMENTS 5,682,774 A * 11/1997 Baumgartner ..... 68/235 R
5,837,143 A * 11/1998 Mercier ..... 210/222 X
5,946,951 A * 9/1999 Watanabe ..... 68/17 R X
5,978,994 A * 11/1999 Anderson ..... 68/17 R X
6,012,308 A * 1/2000 Smulowitz ..... 68/235 R
6,153,151 A * 11/2000 Moxley et al. ..... 68/13 A X
6,250,118 B1 * 6/2001 Kim ..... 68/17 R

* cited by examiner

*Primary Examiner*—Philip R. Coe

(57) ABSTRACT

An magnetic/electromagnetic apparatus and process for for laundering garments in an industrial, commercial or residential application with the steps of: Application of permanent magnetics or electromagnetism to the interior or exterior of a washing machine to elevate the normal cleaning ability of water via increasing solvency by magnetic influence to clean laundry without the use of chemical laundry detergents; magnetic apparatus is submerged in washing water inside drum of machine, affixed to the exterior of the drum where water is contained, or to the incoming water line to the machine; a plurality of shapes and sizes whereby the magnetic apparatus may be placed within or permanently installed on/in either a commercial or residential sized washing machine; apparatus is within a close proximity to the wash water whereby the magnetic emittance may effectively induce eddy currents to affect the water; a plurality of magnetic apparatuses may be necessary for any washing machine exceeding 5 pound laundry capacity up to, and including, industrial tunnel washers; an affixation for exterior installation on industrial applications that secure magnetic apparatus to the exterior bottom and side of the water drum, to the inside of the water drum, or the incoming water line; and the apparatus itself will have a durable exterior housing that may be made of a variety of materials, shapes, sizes and colors.

9 Claims, 4 Drawing Sheets

MAGNETIC/ELECTROMAGNETIC APPARATUS AND PROCESS FOR LAUNDERING GARMENTS IN AN INDUSTRIAL, COMMERCIAL OR RESIDENTIAL MEDIUM

BACKGROUND OF THE INVENTION

This invention relates generally to the field of laundry care, and more particularly to a magnetic/electromagnetic apparatus and process that is in whole, or in part magnetic, for laundering garments free and independently of chemical laundry detergents in an industrial, commercial or residential medium.

This invention relates specifically to the application of magnetic energy to increase the natural solvency of water to clean garments in any laundering application. It is meant to replace the need for chemical laundry detergents.

Magnetism is a well known natural force, and objects that employ it are known as magnets. By the close of the 1800's, all of the elements were known to have some kind of magnetic characteristic. Those that lived in the ancient world could find the magnetic force because certain minerals and rocks are magnetic in their natural state. Materials which keep their magnetism autonomous of their environment are called permanent magnets. Those devices that can induce magnetic force using electricity are known as electromagnetic devices. The study of magnetic hydrodynamics, or the magnetic influence of water, is more than 100 years old. Research and development began with 1902 Nobel Prize winning physicist Hendrick Antoon Lorentz.

This invention may comprise either permanent magnetic or electromagnetic force. It utilizes the force of magnetism to alter the basic nature of water and increase its natural solvency, therefore making water "wetter" and better able to penetrate the garments to release stains and smells. The process has shown to work in both residential and commercial applications with impressive results, used both inside and on the outside water drum of machines completely free and independent of laundry detergent.

Chemical laundry detergents have been used for increasing the natural solvency of water to clean clothes since 1947. They chemically lower the surface tension of water to clean clothes, and hold soil in suspension until it is flushed down the sewage system.

Chemical laundry detergents are consumable, and are flushed into the natural environment after use. They must be purchased again and again. Some studies have shown that these flushed chemicals may cause certain levels of environmental degradation. Because the chemicals need to be flushed out of the garments, extra water, electricity, etc. is needed in a rinse cycle. The magnetic apparatus has shown to replace the need for detergents, and releases nothing derogatory into the environment. It virtually eliminates the need for a rinse cycle. It is a non-consumable and may be used as long as magnetic eddy currents are produced. Permanent magnets have been known to last well over 100 years.

SUMMARY OF THE INVENTION

The primary object of the invention is to provide an efficient, practical magnetic apparatus of simple construction which will replace the need for chemical detergents to clean garments in a laundry washing machine of any size.

Another object of the invention is to provide a magnetic apparatus for laundering garments that may be placed or installed on the inside of the washing machine or secured on the exterior of the water drum of the washing machine.

Another object of the invention is to provide a viable and cost effective alternative and replacement of chemical laundry detergents.

A further object of the invention is to provide a magnetic apparatus for laundering garments that may be used in concert with either an industrial sized laundry machine or a residential laundry machine.

Yet another object of the invention is to significantly reduce the amount of chemical pollutants dispersed into the natural environment from commercial and residential laundry applications by eliminating the need for chemical detergents.

Still yet another object of the invention is to reduce the amount of fresh water used in laundry washing applications by reducing or eliminating the need for rinsing out laundry chemicals and thereby diminishing costly laundry rinse cycles.

Another object of the invention is to create water, chemical, electricity, sewage and water heating savings by reducing overall run times by reducing said rinse cycles.

Another object of the invention is to reduce tensile strength fabric breakdown from chemicals by using a nonchemical based, magnetic cleaning method.

Other objects and advantages of the present invention will become apparent from the following descriptions, taken in connection with the accompanying drawings, wherein, by way of illustration and example, an embodiment of the present invention is disclosed.

A magnetic/electromagnetic apparatus comprising: Application of permanent magnetics or electromagnetism to the interior or exterior of a washing machine to elevate the normal cleaning ability of water via increasing solvency by magnetic influence to clean laundry without the use of laundry detergents. Magnetic apparatus is submerged in washing water inside drum of machine, affixed to the exterior of the drum where water is contained, or the incoming water line to the machine. The invention comprises a plurality of shapes and sizes whereby magnetic apparatus may be placed within, or permanently installed on/in, either a commercial or residential sized washing machine. Apparatus is within a close proximity to the wash water whereby the magnetic emittance may effectively induce eddy currents to affect the water. A plurality of magnetic apparatuses may be necessary for any washing machine exceeding 5 pound laundry capacity up to, and including, industrial tunnel washers. An affixation may be used for exterior installation on industrial applications that secure magnetic apparatus(es) to the exterior bottom and side of the water drum, to the inside of the water drum, or the incoming water line.

A process for comprising the steps of: Application of permanent magnetics or electromagnetism to the interior or exterior of a washing machine to elevate the normal cleaning ability of water via increasing solvency by magnetic influence to clean laundry without the use of laundry detergents. Magnetic apparatus is submerged in washing water inside drum of machine, affixed to the exterior of the drum where water is contained, or the incoming water line to the machine. The invention comprises a plurality of shapes and sizes whereby magnetic apparatus may be placed within, or permanently installed on/in, either a commercial or residential sized washing machine. Apparatus is within a close proximity to the wash water whereby the magnetic emittance may effectively induce eddy currents to affect the water. A plurality of magnetic apparatuses may be necessary for any washing machine exceeding 10 pound laundry capacity up to, and including, industrial tunnel washers. An affixation may be used for exterior installation on industrial applications that secure magnetic apparatus(es) to the exterior bottom and side of the water drum, to the inside of the water drum, or the incoming water line.

The drawings comprise a portion of specifications and include possible embodiments to the invention, which may be embodied in various forms. The invention is comprised, but not limited to, these particular embodiments. It is to be understood that in some instances various aspects of the invention may be shown exaggerated or enlarged to facilitate an understanding of the invention.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
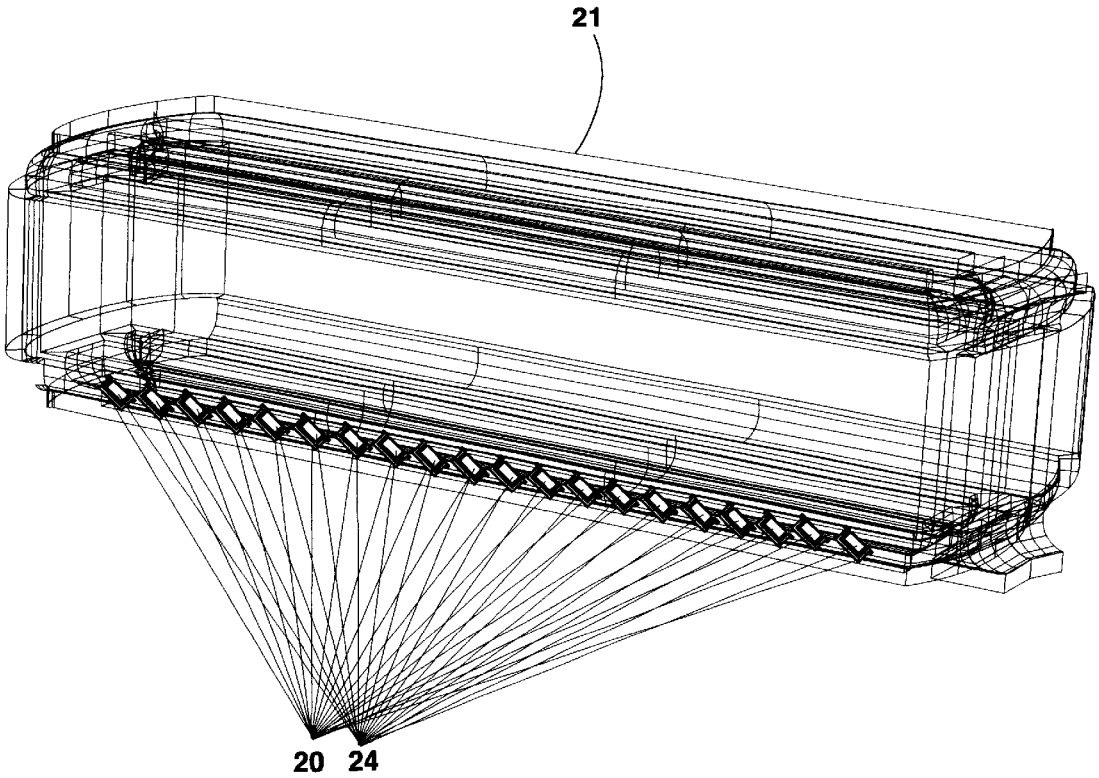
FIG. 1 is a perspective view of a multiple chamber, industrial sized tunnel washer, with the invention installed all along the exterior bottom of the water chamber on both sides.

Turning first to FIG. 1, there is shown a view of the invention installed on an industrial laundry machine. Parts 20 show an affixation for exterior installation on industrial application that secures the magnetic apparatuses to the exterior bottom and side of the water drum of the machine; part 21 shows a diagram of a multi-chamber, industrial sized tunnel washing machine; and parts 24 show the magnetic apparatuses to elevate the normal cleaning ability of water via increasing solvency by magnetic influence to clean laundry free and independent of laundry detergents; Apparatuses are within a close proximity to the wash water whereby the magnetic emittance may effectively induce eddy currents to ionize and "soften" the water to clean clothes.

Figure 2:
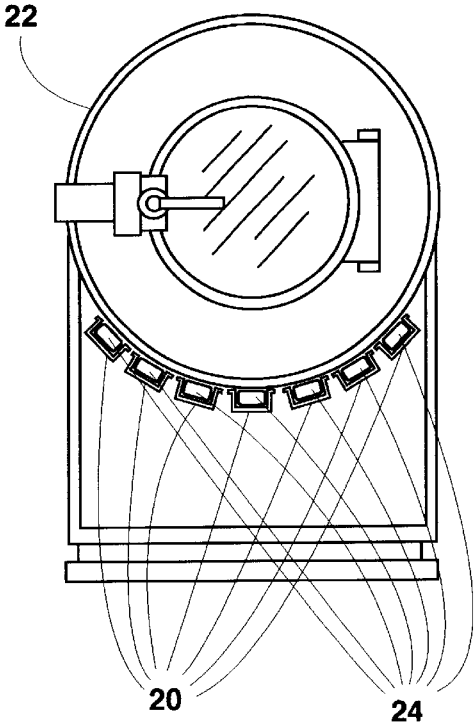
FIG. 2 is a plan view of a washing machine, with the invention installed below the water chamber.

Turning to FIG. 2, there is shown a view of the invention installed on the exterior water drum of a laundry machine. Parts 20 show an affixation for exterior installation on a laundry machine application that secures the magnetic apparatuses to the exterior bottom and side of the water drum of the machine; part 22 shows a frontal view of a horizontal axis laundry washing machine; and parts 24 show the magnetic apparatuses to elevate the normal cleaning ability of water via increasing solvency by magnetic influence to clean laundry free and independent of laundry detergents; Apparatuses are within a close proximity to the wash water whereby the magnetic emittance may effectively induce eddy currents to ionize and "soften" the water to clean clothes.

Figure 3:
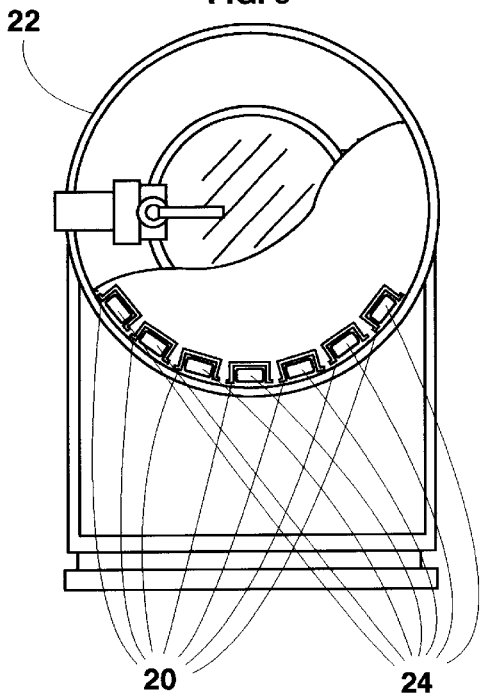
FIG. 3 is a cross sectional view of a washing machine, with the invention installed inside the water chamber.

Turning to FIG. 3, there is shown a view of the invention installed on the interior water drum of a laundry machine. Parts 20 show an affixation for interior installation on a laundry machine application that secures the magnetic apparatuses to the interior bottom and side of the water drum of the machine; part 22 shows a frontal view of a horizontal axis laundry washing machine; and parts 24 show the magnetic apparatuses to elevate the normal cleaning ability of water via increasing solvency by magnetic influence to clean laundry free and independent of laundry detergents; Apparatuses are within a close proximity to the wash water whereby the magnetic emittance may effectively induce eddy currents to ionize and "soften" the water to clean clothes.

Figure 4:
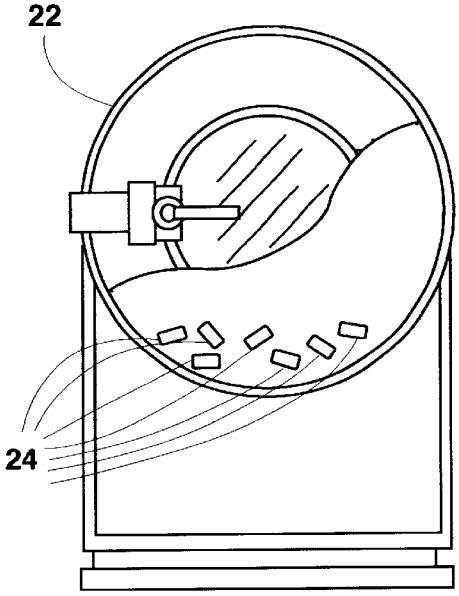
FIG. 4 is a cross sectional view of a washing machine, with the invention placed unrestricted inside the water chamber.

Turning to FIG. 4, there is shown a view of the invention placed loosely in the interior water drum of a laundry machine, free to move about with the laundry. Part 22 shows a frontal view of a horizontal axis laundry washing machine; and parts 24 show the magnetic apparatuses to elevate the normal cleaning ability of water via increasing solvency by magnetic influence to clean laundry free and independent of laundry detergents; Apparatuses are placed loosely in the wash water whereby the magnetic emittance may effectively induce eddy currents to ionize and "soften" the water to clean clothes.

Figure 5:
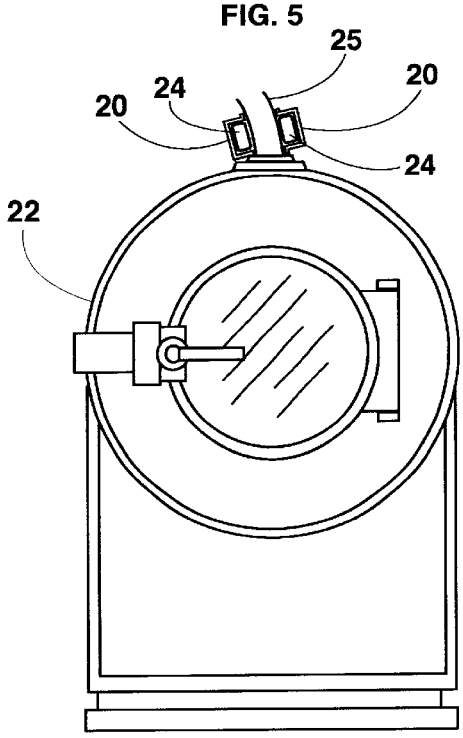
FIG. 5 is a plan view of a washing machine, with the invention installed around the exterior of the incoming water line to the washing machine.

Turning to FIG. 5, there is shown a view of the invention installed on the incoming water line of a laundry machine. Parts 20 show an affixation for exterior installation on the incoming water line of a laundry machine that secures the magnetic apparatuses to the water line; part 22 shows a frontal view of a horizontal axis laundry washing machine; parts 24 show the magnetic apparatuses to elevate the normal cleaning ability of water via increasing solvency by magnetic influence to clean laundry free and independent of laundry detergents; Apparatuses are within a close proximity to the wash water, specifically the incoming water line, whereby the magnetic emittance may effectively induce eddy currents to ionize and "soften" the water to clean clothes; and part 25 shows the incoming water line of a laundry machine.

Figure 6:
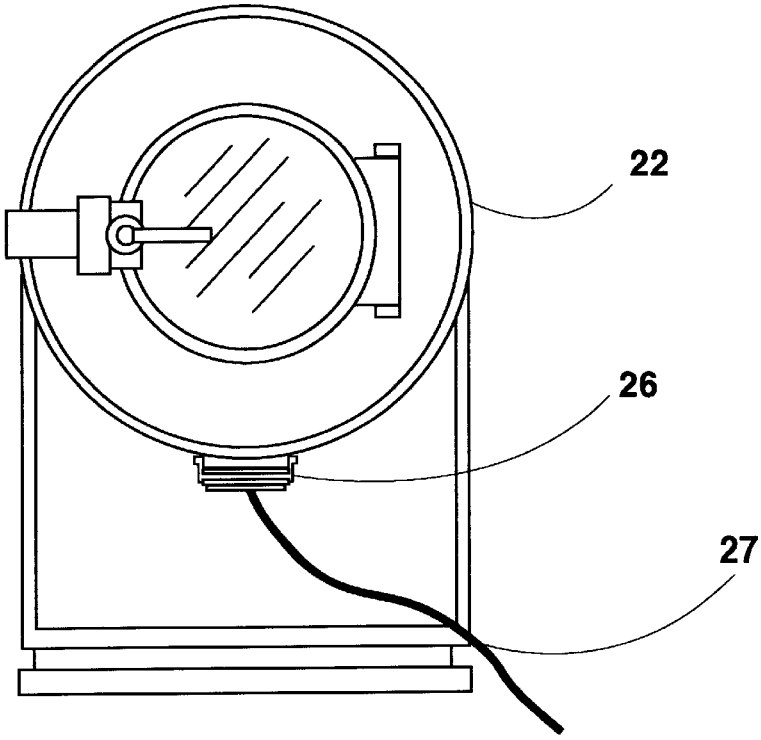
FIG. 6 is a plan view of a washing machine, comprising an electromagnetic version of the invention installed below the water chamber.

Turning to FIG. 6, there is shown a view of an electromagnetic version of the invention installed on the exterior water drum of a laundry machine. Part 22 shows a frontal view of a horizontal axis laundry washing machine; part 26 shows an electromagnetic apparatus to elevate the normal cleaning ability of water via increasing solvency by electromagnetic influence to clean laundry free and independent of laundry detergents; Apparatus is within a close proximity to the wash water whereby the electromagnetic emittance may effectively induce eddy currents to ionize and "soften" the water to clean clothes; the apparatus may be powered by battery, or plug-in electrical current; and part 27 is a power cord that may be used to power the unit to create adequate electromagnetic emittance.

Figure 7:
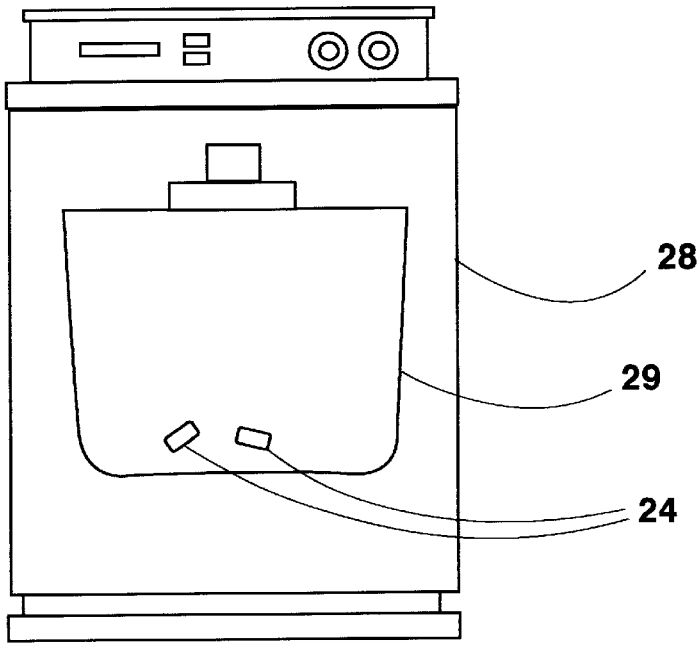
FIG. 7 is a plan view of a top loading residential washing machine, with the invention placed unrestricted in the water chamber.

Turning to FIG. 7, there is shown a view of the invention placed loosely in the interior water drum of a residential laundry machine, free to move about with the laundry. Parts 24 show the magnetic apparatuses to elevate the normal cleaning ability of water via increasing solvency by magnetic influence to clean laundry free and independent of laundry detergents; Apparatuses are placed loosely in the wash water whereby the magnetic emittance may effectively induce eddy currents to ionize and "soften" the water to clean clothes; part 28 shows a frontal view of a top loading, residential laundry washing machine; part 29 shows the interior water drum of a top loading, residential laundry machine.

Figure 8:
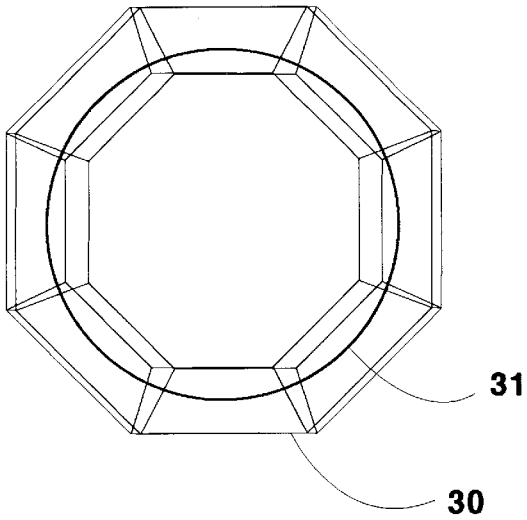
FIG. 8 is an elevational view of the invention comprising an octagonal shape.

Turning to FIG. 8, there is shown the top view of a the magnetic apparatus to elevate the normal cleaning ability of water via increasing solvency by magnetic influence to clean laundry free and independent of laundry detergents; Part 30 shows the exterior shell of the apparatus which is durable, and may be made of a variety of materials comprising any practical plastic, rubber, metallic or synthetic substance; it may be any color and it may be clear or transparent; it may be a plurality of shapes and sizes for a miscellany of useful applications, with this example being an octagonal shape; part 31 is the permanent magnet(s) inside the exterior shell that may be of any variety of magnetized material, comprising ceramic, iron, neodymium and rare earth magnets.

Figure 9:
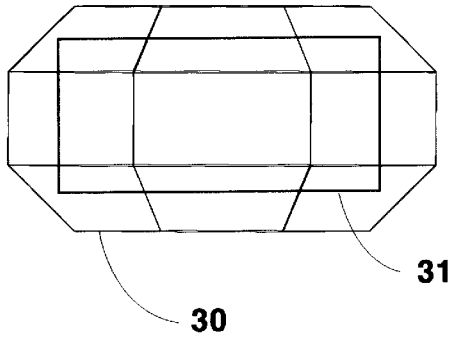
FIG. 9 is a side view of the invention comprising an octagonal shape.

Turning to FIG. 9, there is shown the side view of a the magnetic apparatus to elevate the normal cleaning ability of water via increasing solvency by magnetic influence to clean laundry free and independent of laundry detergents; Part 30 shows the exterior shell of the apparatus which is durable, and may be made of a variety of materials comprising any practical plastic, rubber, metallic or synthetic substance; it may be any color and it may be clear or transparent; it may be a plurality of shapes and sizes for a miscellany of useful applications, with this example being an octagonal shape; part 31 is the permanent magnet(s) inside the exterior shell that may be of any variety of magnetized material, comprising ceramic, iron, neodymium and rare earth magnets.

Figure 10:
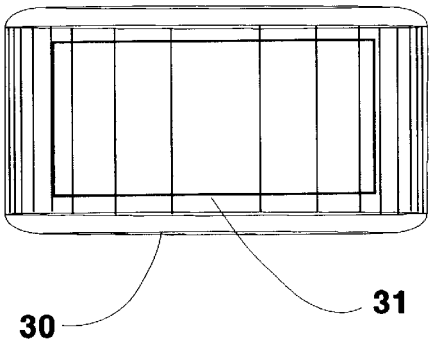
FIG. 10 is a side view of the invention comprising a spherical shape.

Turning to FIG. 10, there is shown the side view of a the magnetic apparatus to elevate the normal cleaning ability of water via increasing solvency by magnetic influence to clean laundry free and independent of laundry detergents; Part 30 shows the exterior shell of the apparatus which is durable, and may be made of a variety of materials comprising any practical plastic, rubber, metallic or synthetic substance; it may be any color and it may be clear or transparent; it may be a plurality of shapes and sizes for a miscellany of useful applications, with this example being a spherical shape; part 31 is the permanent magnet(s) inside the exterior shell that may be of any variety of magnetized material, comprising ceramic, iron, neodymium and rare earth magnets.

Figure 11:
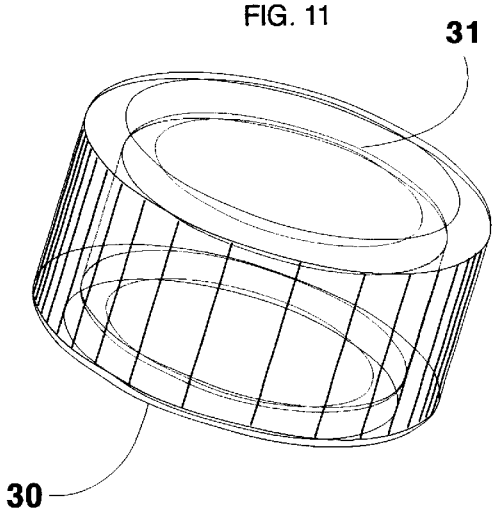
FIG. 11 is a perspective view of the invention comprising a spherical shape.

Turning to FIG. 11, there is shown a perspective view of a the magnetic apparatus to elevate the normal cleaning ability of water via increasing solvency by magnetic influence to clean laundry free and independent of laundry detergents; Part 30 shows the exterior shell of the apparatus which is durable, and may be made of a variety of materials comprising any practical plastic, rubber, metallic or synthetic substance; it may be any color and it may be clear or transparent; it may be a plurality of shapes and sizes for a miscellany of useful applications, with this example being a spherical shape; part 31 is the permanent magnet(s) inside the exterior shell that may be of any variety of magnetized material, comprising ceramic, iron, neodymium and rare earth magnets.

Figure 12:
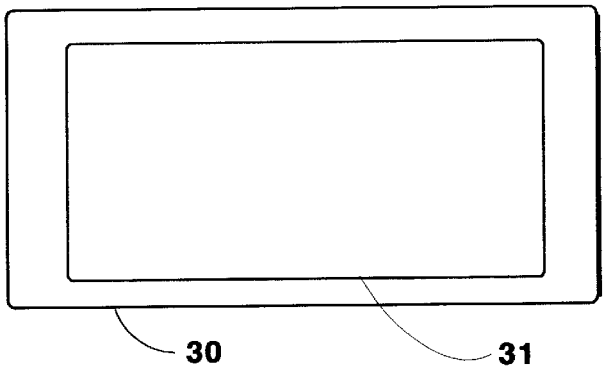
FIG. 12 is an elevational view of the invention comprising a rectangular shape.

Turning to FIG. 12, there is shown the top view of a the magnetic apparatus to elevate the normal cleaning ability of water via increasing solvency by magnetic influence to clean laundry free and independent of laundry detergents; Part 30 shows the exterior shell of the apparatus which is durable, and may be made of a variety of materials comprising any practical plastic, rubber, metallic or synthetic substance; it may be any color and it may be clear or transparent; it may be a plurality of shapes and sizes for a miscellany of useful applications, with this example being a rectangular shape; part 31 is the permanent magnet(s) inside the exterior shell that may be of any variety of magnetized material, comprising ceramic, iron, neodymium and rare earth magnets.

Figure 13:
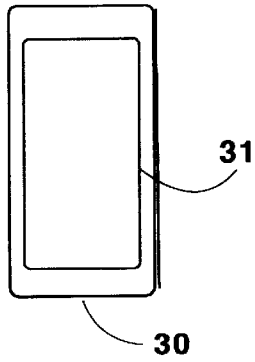
FIG. 13 is a side view of the invention comprising a rectangular shape.

Turning to FIG. 13, there is shown a side view of a the magnetic apparatus to elevate the normal cleaning ability of water via increasing solvency by magnetic influence to clean laundry free and independent of laundry detergents; Part 30 shows the exterior shell of the apparatus which is durable, and may be made of a variety of materials comprising any practical plastic, rubber, metallic or synthetic substance; it may be any color and it may be clear or transparent; it may be a plurality of shapes and sizes for a miscellany of useful applications, with this example being a rectangular shape; part 31 is the permanent magnet(s) inside the exterior shell that may be of any variety of magnetized material, comprising ceramic, iron, neodymium and rare earth magnets.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. In a laundry washing apparatus comprising:

exterior frame with an interior side and an exterior side;

an interior drum with an interior side and exterior side;

said interior drum having a cavity within said drum that holds articles to be laundered and washing water;

a magnetic field inducing means that induces a magnetic field within said washing water;

a means for affixing said magnetic field inducing means in proximity to said drum so as to induce a magnetic field in said washing water;

whereby the wash water is ionized, softening the water and permitting clothes to be laundered without the necessity of detergent.

2. In a laundry washing apparatus described in claim 1 where said means for inducing a magnetic field is at least one permanent magnet.

3. In a laundry washing apparatus described in claim 1 where said means for inducing a magnetic field is at least one electromagnet.

4. In a laundry washing apparatus described in claim 1 where said means for inducing a magnetic field is affixed to the exterior side of said interior drum.

5. In a laundry washing apparatus described in claim 1 where said means for inducing a magnetic field is affixed to the interior side of said interior drum.

6. In a laundry washing apparatus described in claim 1 where said means for inducing a magnetic field is affixed to the interior side of said exterior frame.

7. In a laundry washing apparatus described in claim 1 where the affixing means is at least one bolt.

8. In a laundry washing apparatus described in claim 1 where the affixing means is at least one screw.

9. In a laundry washing apparatus described in claim 1 where the affixing means is an adhesive.

* * * * *